US007683592B2

(12) United States Patent
Soude et al.

(10) Patent No.: US 7,683,592 B2
(45) **Date of Patent: *Mar. 23, 2010**

(54) LOW DROPOUT VOLTAGE REGULATOR WITH SWITCHING OUTPUT CURRENT BOOST CIRCUIT

(75) Inventors: Thierry Soude, Marseilles (FR); Frederic Demolli, Rognac (FR); Joao Pedro Antunes Carreira, Pourriere (FR)

(73) Assignee: Atmel Corporation, San Jose, CA (US)

( * ) Notice: Subject to any disclaimer, the term of this patent is extended or adjusted under 35 U.S.C. 154(b) by 159 days.

This patent is subject to a terminal disclaimer.

(21) Appl. No.: 11/516,535

(22) Filed: Sep. 6, 2006

(65) Prior Publication Data

US 2008/0054867 A1 Mar. 6, 2008

(51) Int. Cl.
*G05F 1/565* (2006.01)
*G05F 1/00* (2006.01)

(52) U.S. Cl. ..... 323/275; 323/269; 323/274; 323/285

(58) Field of Classification Search ..... 323/280–282, 323/273–275, 269, 285
See application file for complete search history.

(56) References Cited

U.S. PATENT DOCUMENTS

| | | | | |
|---|---|---|---|---|
| 4,008,418 | A | | 2/1977 | Murphy |
| 4,543,522 | A | | 9/1985 | Moreau |
| 5,130,635 | A | | 7/1992 | Kase |
| 5,629,609 | A | * | 5/1997 | Nguyen et al. ..... 323/269 |
| 5,686,820 | A | | 11/1997 | Riggio, Jr. |
| 5,847,551 | A | | 12/1998 | Arora et al. |
| 5,864,227 | A | | 1/1999 | Borden et al. |
| 5,952,817 | A | | 9/1999 | Brewster et al. |
| 5,966,004 | A | | 10/1999 | Kadanka |
| 6,046,577 | A | | 4/2000 | Rincon-Mora et al. |
| 6,188,211 | B1 | | 2/2001 | Rincon-Mora et al. |
| 6,188,212 | B1 | | 2/2001 | Larson et al. |
| 6,201,375 | B1 | | 3/2001 | Larson et al. |
| 6,333,623 | B1 | | 12/2001 | Heisley et al. |

(Continued)

FOREIGN PATENT DOCUMENTS

WO WO-2007120906 A2 10/2007

(Continued)

OTHER PUBLICATIONS

"U.S. Appl. No. 11/708,725, Non Final Office Action mailed Oct. 30, 2008", 7 pgs.

(Continued)

*Primary Examiner*—Jessica Han
*Assistant Examiner*—Emily Pham
(74) *Attorney, Agent, or Firm*—Schwegman, Lundberg & Woessner, P.A.

(57) ABSTRACT

A low dropout voltage regulator with switching output current boost circuit. In one aspect of the invention, a voltage regulator circuit includes a low dropout voltage regulator providing an output voltage at an output based on an input voltage at an input, and a boost circuit connected to the low dropout voltage regulator. The boost circuit includes a comparator and a boost transistor device for allowing additional current to be provided to the output of the low dropout voltage regulator when the output voltage of the current regulator falls below a predetermined threshold.

20 Claims, 1 Drawing Sheet

U.S. PATENT DOCUMENTS

| | | | | |
|---|---|---|---|---|
| 6,373,233 | B2 * | 4/2002 | Bakker et al. | 323/282 |
| 6,377,033 | B2 | 4/2002 | Hsu | |
| 6,469,480 | B2 * | 10/2002 | Kanakubo | 323/269 |
| 6,501,252 | B2 | 12/2002 | Fujise | |
| 6,501,305 | B2 | 12/2002 | Rincon-Mora et al. | |
| 6,518,737 | B1 | 2/2003 | Stanescu et al. | |
| 6,522,111 | B2 | 2/2003 | Zadeh et al. | |
| 6,522,114 | B1 | 2/2003 | Bakker et al. | |
| 6,650,093 | B1 | 11/2003 | Baldwin et al. | |
| 6,710,583 | B2 | 3/2004 | Stanescu et al. | |
| 6,897,637 | B2 | 5/2005 | Chen et al. | |
| 7,135,912 | B2 | 11/2006 | Perez | |
| 7,199,565 | B1 * | 4/2007 | Demolli | 323/273 |
| 2003/0111985 | A1 | 6/2003 | Xi | |
| 2003/0111987 | A1 | 6/2003 | Chen et al. | |
| 2004/0021503 | A1 | 2/2004 | Hulfachor et al. | |
| 2005/0189930 | A1 | 9/2005 | Wu et al. | |
| 2006/0273771 | A1 * | 12/2006 | van Ettinger et al. | 323/273 |
| 2007/0146020 | A1 * | 6/2007 | Williams | 327/110 |

FOREIGN PATENT DOCUMENTS

WO WO-2007120906 A3 10/2007

OTHER PUBLICATIONS

"U.S. Appl. No. 11/708,725, Non Final Office Action mailed Oct. 1, 2007", 6 pgs.

" U.S. Appl. No. 11/708,725, Non Final Office Action mailed Jun. 11, 2007", 4 pgs.

" U.S. Appl. No. 11/708,725, Non-Final Office Action mailed Apr. 10, 2008", 8 pgs.

" U.S. Appl. No. 11/708,725, Response filed Dec. 20, 2007 to Non Final Office Action mailed Oct. 1, 2007", 10 pgs.

" U.S. Appl. No. 11/708,725, Response filed Aug. 15, 2007 to Non Final Office Action mailed Jun. 11, 2007", 4 pgs.

" U.S. Appl. No. 11/708,725, Response filed Jan. 30, 2009 to Final Office Action mailed Oct. 30, 2008", 13 pages.

" U.S. Appl. No. 11/708,725, Response filed Feb. 27, 2009 to Final Office Action mailed Oct. 30, 2008", 14 pages.

" U.S. Appl. No. 11/708,725, Response filed Jul. 7, 2008 to Non-Final Office Action mailed Apr. 10, 2008", 11 pgs.

" U.S. Appl. No. 11/708,725, Notice of Allowance mailed Mar. 24, 2009", NOAR, 5 pgs.

Rempfler, William, "LTC1272: Single-Supply, Sampling 12-Bit ADC Guarantees 3-Microsecond Conversions", *Linear Technology Magazine*, 1(2), (Oct. 1991), 1, 8-10.

Rincon-Mora, Gabriel A, et al., "A low-voltage, low quiescent current, low drop-out regulator", *IEEE Journal of Solid-State Circuits*, 33(1), (Jan. 1998), 36-44.

" U.S. Appl. No. 11/708,725, Advisory Action mailed Feb. 20, 2009", 3 pgs.

" U.S. Appl. No. 11/708,725, Examiner Interview Summary mailed Apr. 10, 2009", 3 pgs.

" U.S. Appl. No. 11/708,725, Notice of Allowance mailed Sep. 9, 2009", 5 pgs.

* cited by examiner

LOW DROPOUT VOLTAGE REGULATOR WITH SWITCHING OUTPUT CURRENT BOOST CIRCUIT

FIELD OF THE INVENTION

The present invention relates to voltage regulators for electronic circuits, and more particularly to low dropout voltage regulators for circuits.

BACKGROUND OF THE INVENTION

Low dropout (LDO) voltage regulators are used in a variety of applications in electronic devices to supply power. These types of voltage regulators can provide a reliable and accurate DC voltage signal for devices sensitive to variations in received power. An LDO regulator provides a low dropout voltage, i.e., a small input-to-output differential voltage, allowing the input voltage to be only a small amount above the desired output voltage, as is desired for low-voltage microprocessors in such applications as portable electronic devices and the like. The fixed output voltage can be provided for varying loads.

The main components of a typical LDO regulator include a power transistor (such as a FET) and a differential amplifier (error amplifier). One input of the error amplifier monitors a percentage of the output, as determined by a resistance divider. The second input to the error amplifier is provided by a voltage reference. If the output voltage rises too high relative to the reference voltage, the signal to the power transistor changes so as to maintain a constant output voltage. If the output voltage is too low, the output voltage is similarly adjusted to a greater value. An output load capacitor is often included to buffer oscillation which may occur in the output voltage depending on provided currents.

In some applications for an LDO voltage regulator, switching output current peaks may occur. For example, when writing or reading a block of memory in a flash memory or electrical eraseable programmable read only memory (EEPROM), current peaks can occur due to the switching of memory circuits connected to the output of the regulator. Current switching peaks may also occur in the use of high speed digital circuits. In such situations, the LDO regulator sources the required current to the load; however, the LDO regulator requires a delay to source this required current. This delay can be caused by the limited bandwidth of the LDO regulator, as well as its limited internal slew-rate. During this delay, the dropout of the output voltage only depends on the output voltage value provided by the output capacitor and is thus not being regulated by the LDO regulator. As a consequence, the output voltage tends to fall down dramatically before the LDO regulator finally can regulate the output voltage to the desired level.

Currently there are two methods that are typically used to limit the dropout of LDO regulators caused by switching current peaks. In one method, the capacitance of the output load capacitor is increased. However, this solution can be unsuitable for applications where the load capacitor is implemented directly on an integrated circuit chip. The total area of the integrated circuit chip already limits the on-chip capacitance value of the capacitor, and a significant increase in the output capacitor value would occupy an even larger area. To accommodate such a larger capacitor would prohibitively increase the cost of the integrated circuit.

In another solution, the bandwidth and slew-rate of the LDO regulator are increased. However, to achieve this higher performance the LDO regulator current consumption must be increased, and higher current consumption is often a major concern when used in such applications as portable devices or battery-powered applications. Thus, in such applications, increasing the LDO bandwidth and slew-rate is typically not a viable option.

Accordingly, an LDO voltage regulator that can sustain higher current peaks at its output without the use of increased load capacitance or higher current consumption of the regulator, would be desirable in many applications.

SUMMARY OF THE INVENTION

The invention of the present application relates to low dropout voltage regulators for electronic circuits. In one aspect of the invention, a voltage regulator circuit includes a low dropout voltage regulator providing an output voltage at an output based on an input voltage at an input, and a boost circuit connected to the low dropout voltage regulator. The boost circuit includes a comparator and a boost transistor device for allowing additional current to be provided to the output of the low dropout voltage regulator when the output voltage of the current regulator falls below a predetermined threshold.

In another aspect of the invention, a voltage regulator circuit includes a low dropout voltage regulator including an amplifier connected to a voltage reference at a first input of the amplifier, and a first transistor device connected to the output of the amplifier and between a voltage input and a voltage output of the low dropout voltage regulator. A boost circuit is connected to the low dropout voltage regulator, the boost circuit including a comparator connected to the voltage reference at a first input of the comparator, and a second transistor device connected to the output of the comparator and between the input and the output to the low dropout voltage regulator. A resistor feedback network includes three resistors connected in series between the transistor devices and ground, where a first feedback voltage provided between the second and third resistors is connected to a second input of the amplifier, and a second feedback voltage provided between the first and second resistors is connected to a second input of the comparator.

In another aspect of the invention, a method for regulating voltage using a voltage regulator circuit includes providing a low dropout voltage regulator that provides a regulated voltage at an output based on a voltage at an input of the voltage regulator. A boost circuit is provided and is connected to the voltage regulator, the boost circuit including a comparator and a boost transistor device for allowing additional current to be provided to the output of the low dropout voltage regulator from the voltage at the input when the output voltage of the voltage regulator falls below a predetermined threshold for which the voltage regulator is not able to compensate.

The present invention provides a low dropout voltage regulator circuit that includes a switching output current boost circuit that sustains the output of the regulator during current peaks that normally lead to voltage drops. The stability of the regulator output is maintained without having to use a larger output capacitor or regulator components with significantly higher current consumption, thus allowing use of the regulator in integrated circuits and battery-powered electronic device applications.

DETAILED DESCRIPTION

Figure 1:
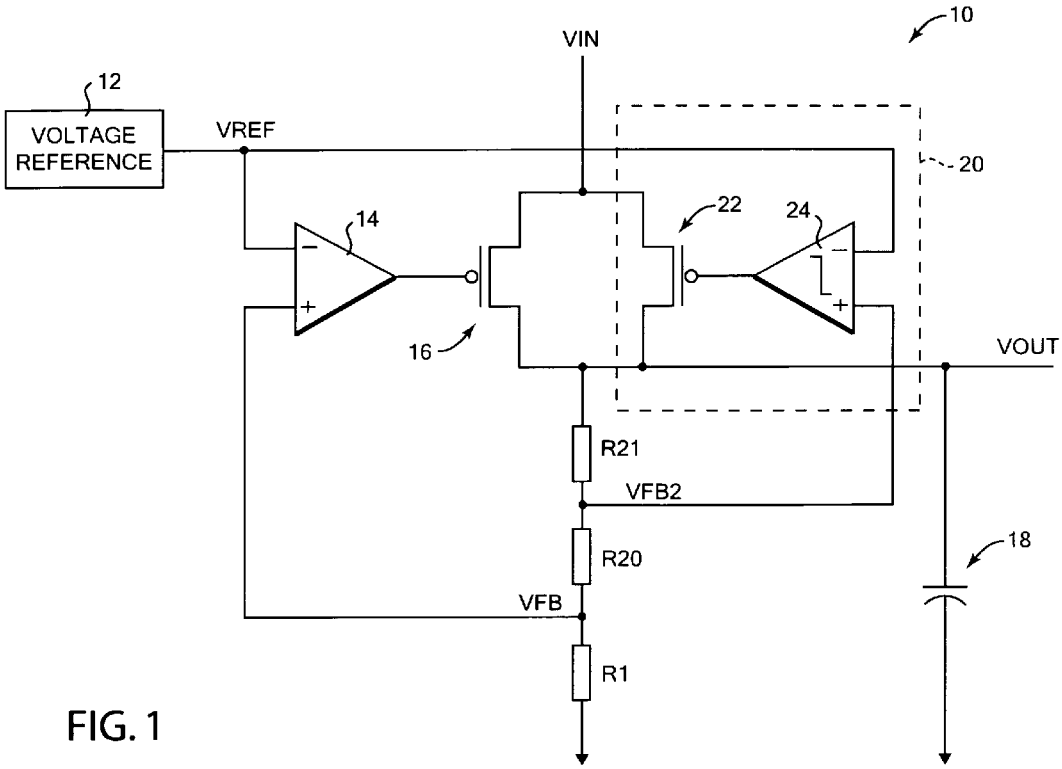
FIG. 1 is a schematic diagram of a low dropout voltage regulator circuit including an output current boost circuit of the present invention.

The present invention relates to voltage regulators for electronic circuits, and more particularly to low dropout voltage regulators for circuits. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

The present invention is mainly described in terms of particular circuits provided in particular implementations. However, one of ordinary skill in the art will readily recognize that this circuit will operate effectively in other implementations.

To more particularly describe the features of the present invention, please refer to FIG. 1 in conjunction with the discussion below.

FIG. 1 is a schematic view of a voltage regulator circuit 10 of the present invention. The voltage regulator circuit 10 includes a low dropout (LDO) voltage regulator, including a voltage reference 12, an error amplifier 14, and a regulator transistor device 16.

The voltage reference 12 supplies a reference voltage VREF for the regulator circuit 10. The reference voltage VREF line is connected to the negative input terminal of error amplifier 14, which has an output connected to the gate of regulator transistor device or primary pass device 16. Transistor 16 is shown in the embodiment of FIG. 1 as a PMOS transistor. An input voltage VIN is connected to the source of the transistor 16.

A resistance divider (resistor feedback network) is connected to the drain of the transistor 16. The resistance divider includes three resistors R21, R20, and R1, connected in series from the drain of the transistor 16 to ground. A voltage feedback signal VFB is connected between the second and third resistors, R20 and R1, and is fed back to the positive input terminal of the error amplifier 14. A voltage output signal for the regulator 10 is connected to the drain of the transistor 16. An output load capacitor 18 is connected between the output voltage signal VOUT and ground.

The voltage regulator components described above function as a standard LDO voltage regulator, where VFB operates as a first threshold. The error amplifier 14 compares the feedback voltage VFB, which is a percentage of the output voltage VOUT as determined by the ratio of resistors (R20+R21) and R1, to the voltage VREF from the voltage reference 12. The LDO regulator thus delivers current to the output VOUT via the primary pass device 16 and which is fed back to the error amplifier 14 though the feedback network (R1/(R1+R20+R21)) ((R21+R20)/(R1+R20+R21)). Thus the error amplifier's positive input is connected via the feedback network to a voltage of VFB=(R1/(R1+R20+R21))*VOUT. If VFB drops, the error amplifier compensates by increasing drive to the transistor 16, thus increasing the output voltage VOUT. If VFB rises, then the error amplifier decreases the drive to the transistor device 16, thereby decreasing the output voltage VOUT. The error amplifier output is connected to the gate terminal of transistor device 16 so as to ensure that VOUT is equal to ((R1+R20+R21)/R1)*VREF during normal operation. Thus, the error amplifier output seeks to equalize the voltages at the inputs to the amplifier, to provide a regulated output voltage VOUT that is independent of variations in the supply voltage VIN or load current variations.

The output load capacitor 18 is provided for stability, e.g., to buffer oscillation which may occur in VOUT depending on provided currents. Capacitor 18, however, may be required to be kept to a smaller capacitance value than is desired to compensate for output voltage drops due to switched load changes of the regulator. This may be due to limited available space on an integrated circuit chip, for example, when the capacitor is to be included on the chip itself. Thus, higher output current peaks provided by the regulator may not be sustained with the smaller size capacitor 18.

The regulator circuit 10 of the present invention therefore also includes a switching output current boost circuit 20. Boost circuit 20 allows the deliverance of an additional current to the output during falling output voltage due to high switching output current peaks, and includes a transistor device 22 and a comparator 24. Transistor device (or secondary pass device) 22 is connected to the input voltage VIN at its source and is connected to VOUT and the resistor feedback network at its drain. Transistor 22 is shown as a PMOS device in the embodiment of FIG. 1. Comparator 24 has its output connected to the gate of the transistor 22. The negative input terminal of comparator 24 is connected to the reference voltage VREF, and the positive input terminal is connected to the node between resistors R20 and R21 of the feedback network, such that the resistor divider takes the form of ((R20+R1)/(R1+R20+R21)). Thus, a second feedback voltage VFB2 at the positive input terminal of comparator 24 is ((R20+R1)/(R1+R20+R21))*VOUT.

In operation, the comparator is used to provide a current boost to the output in the event that VOUT goes below a predetermined value, e.g., when an output drop occurs during a switched current peak. For the embodiment of FIG. 1, when VOUT goes below a voltage level that causes the second feedback voltage VFB2 to be less than the reference voltage VREF at the negative input terminal of comparator 24, then the comparator 24 will output a zero voltage level from its output, which causes the secondary transistor 22 to turn on. This causes additional current from the voltage input VIN to be delivered to the output of the regulator 10 to compensate for the lower output voltage and current of the LDO regulator components. At some point the LDO regulator components (error amplifier 14, transistor 16, and resistors R1, R20, and R21) will restore the current to a higher regulated level that causes VOUT to be raised high enough so that VFB2 is higher than VREF, and the output of the comparator 24 goes high, thus turning off transistor 22.

Thus, if during a switching current peak the voltage drops while the voltage regulator is still bringing up its normal voltage regulation, then the boost circuit 20 allows more current to be provided to the output. The lower feedback voltage level of VFB2, acting as a second threshold, is less than the feedback voltage level VFB (first threshold), allowing the boost circuit 20 to pass additional current at a lower voltage level than the normal regulated output voltage level. Thus the resistor values of resistors R21 and R20 are determined based on the desired lower feedback voltage level, the point at which it is desired for the additional current through transistor 22 to be provided.

The present invention thus allows the regulator 10 to sustain a higher level of output current during switched current peaks, without having to increase the size and capacitance of the load capacitor 18. This allows the regulator 10 to be implemented more easily on the limited area of an integrated circuit chip. In addition, the boost circuit 20 of the present invention includes a small number of components including transistor 22 and a simple comparator 24, and the invention includes no changes to the primary LDO voltage regulator;

thus the circuit is quite inexpensive to implement. Furthermore, the additional current consumption of the single comparator 24 is minimal, and so any significant increase in current consumption of the circuit is avoided. This makes the regulator 10 very suitable for portable and power-limited applications, such as battery powered devices.

In an alternate embodiment, other types of transistors for transistors 16 and 22 can be used. For example, other p-channel transistors can be used, such as PNP (in which the collectors would be connected to VOUT, and the emitters connected to VIN). In other embodiments, n-channel transistors can be used, such as NMOS (source connected to VOUT, drain connected to VIN) or NPN (emitter connected to VOUT, collector connected to VIN). If an n-channel transistor is used for primary transistor 16, then the error amplifier 14 should be inverted so that VREF is connected to the positive input and VFB is connected to the negative input of the amplifier. Likewise, if an n-channel resistor is used for secondary transistor 22, the comparator 24 should be inverted such that VREF is connected to the positive input, and VFB2 is connected to the negative input of the comparator.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A voltage regulator circuit, comprising:

an input;

an output;

an error amplifier to receive a reference voltage and a first feedback voltage and to output an error signal, a transistor coupled between the input and the output to receive the error signal, the error amplifier coupled to the transistor;

a boost circuit coupled to the transistor, the boost circuit including a boost transistor and a comparator, wherein the boost transistor is coupled between the input and the output, wherein the comparator is coupled to the boost transistor and to receive the reference voltage and a second feedback voltage, wherein the boost transistor is turned on to pass current from the input to the output when the reference voltage is higher than the second feedback voltage; and a resistor network coupled in series between the output and a ground, the resistor network comprising a first resistor, a second resistor, and a third resistor, wherein the first feedback voltage is tapped between the first resistor and the second resistor, wherein the second feedback voltage is tapped between the second resistor and the third resistor.

2. The voltage regulator circuit of claim 1, comprising a capacitor coupled between the output and ground.

3. The voltage regulator circuit of claim 1, wherein the boost transistor provides additional current at the output when the voltage at the output falls below a predetermined threshold.

4. The voltage regulator circuit of claim 1, wherein a source of the transistor and a source of the boost transistor are coupled to the input.

5. The voltage regulator circuit of claim 1, wherein a drain of the transistor and a drain of the boost transistor are coupled to the output.

6. The voltage regulator circuit of claim 1, wherein the third resistor is directly connected to the output.

7. The voltage regulator circuit of claim 1, wherein the first resistor is directly connected to the ground.

8. The voltage regulator circuit of claim 1, wherein the first feedback voltage is given by the relation: $V_{FB1}=(R_1/(R_1+R_2+R_3))*V_{out}$, wherein, $R_1$ is the resistance of the first resistor, $R_2$ is the resistance of the second resistor, $R_3$ is the resistance of the third resistor, $V_{FB1}$ is the first feedback voltage, and $V_{out}$ is the output voltage.

9. The voltage regulator circuit of claim 1, wherein the second feedback voltage is given by the relation: $V_{FB2}=((R_2+R_1)/(R_1+R_2+R_3))*V_{out}$, wherein, $R_1$ is the resistance of the first resistor, $R_2$ is the resistance of the second resistor, $R_3$ is the resistance of the third resistor, $V_{FB2}$ is the second feedback voltage, and $V_{out}$ is the output voltage.

10. A voltage regulator circuit comprising:

a reference voltage source;

an error amplifier including a first input, a second input, and a first output, the first input to receive a reference voltage from the reference voltage source, the second input to receive a first feedback voltage;

a first transistor including a gate coupled to the first output, a source to receive an input voltage, and a drain coupled to an output;

a boost circuit including:

a comparator including a third input to receive the reference voltage, a fourth input to receive a second feedback voltage, and a comparator output; and a second transistor including a gate coupled to the comparator output, a source to receive the input voltage, and a drain coupled to the output; and a resistor network coupled in series between the output and ground, the resistor network comprising, in series, a first resistor, a second resistor, and a third resistor, wherein the first feedback voltage is tapped between the first resistor and the second resistor, wherein the second feedback voltage is tapped between the second resistor and the third resistor.

11. The voltage regulator circuit of claim 10, wherein the first transistor includes a PMOS transistor.

12. The voltage regulator circuit of claim 10, wherein the second transistor includes a PMOS transistor.

13. The voltage regulator circuit of claim 10, wherein the third resistor includes a node connected to the output.

14. The voltage regulator circuit of claim 10, wherein the first resistor includes a node connected to the ground.

15. A voltage regulator circuit comprising:

a reference voltage source;

an error amplifier including a first input, a second input, and a first output, the first input to receive a reference voltage from the reference voltage source, the second input to receive a first feedback voltage;

a first transistor including a gate coupled to the first output, a source to receive an input voltage, and a drain coupled to an output;

a boost circuit including;

a comparator including a third input to receive the reference voltage, a fourth input to receive a second feedback voltage, and a comparator output: and a second transistor including a gate coupled to the comparator output, a source to receive the input voltage, and a drain coupled to the output; and a resistor network coupled in series between the output and ground, the resistor network comprising, in series, a first resistor, a second resistor, and a third resistor, wherein the first feedback voltage is tapped between the first resistor and the second resistor, wherein the second feedback voltage is tapped between the second resistor and the third resistor and the first feedback voltage is given by the relation: $V_{FB1}=(R_1/(R_1+R_2+R_3))*V_{out}$, wherein, $R_1$ is the resistance of the first resistor, $R_2$ is the resistance of the second resistor, $R_3$ is the resistance of the third resistor, $V_{FB1}$ is the first feedback voltage, and $V_{out}$ is the output voltage.

16. A voltage regulator circuit, comprising:

a reference voltage source:

an error amplifier including a first input, a second input, and a first output, the first input to receive a reference voltage from the reference voltage source, the second input to receive a first feedback voltage;

a first transistor including a gate coupled to the first output, a source to receive an input voltage, and a drain coupled to an output:

a boost circuit including:

a comparator including a third input to receive the reference voltage, a fourth input to receive a second feedback voltage, and a comparator output: and a second transistor including a gate coupled to the comparator output, a source to receive the input voltage, and a drain coupled to the output; and a resistor network coupled in series between the output and ground, the resistor network comprising, in series, a first resistor, a second resistor, and a third resistor, wherein the first feedback voltage is tapped between the first resistor and the second resistor, wherein the second feedback voltage is tapped between the second resistor and the third resistor and the second feedback voltage is given by the relation: $V_{FB2}=((R_2+R_1)/(R_1+R_2+R_3))*V_{out}$, wherein, $R_1$ is the resistance of the first resistor, $R_2$ is the resistance of the second resistor, $R_3$ is the resistance of the third resistor, $V_{FB2}$ is the second feedback voltage, and $V_{out}$ is the output voltage.

17. A voltage regulator circuit, comprising:

an input;

an output;

an error amplifier to receive a reference voltage and a first feedback voltage and output an error signal, the error amplifier coupled to a transistor, the transistor coupled between the input and the output to receive the error signal;

a boost circuit coupled to the transistor, the boost circuit including a boost transistor and a comparator, wherein the boost transistor is coupled between the input and the output, wherein the comparator is coupled to the boost transistor and to receive the reference voltage and a second feedback voltage, wherein the boost transistor is turned on to pass current from the input to the output when the reference voltage is higher than the second feedback voltage; and a resistor network coupled in series between the output and a ground, the resistor network consisting of a first resistor, a second resistor, and a third resistor, wherein the first feedback voltage is tapped between the first resistor and the second resistor, wherein the second feedback voltage is tapped between the second resistor and the third resistor.

18. The voltage regulator circuit of claim 17, wherein the boost transistor includes a PMOS transistor.

19. The voltage regulator circuit of claim 17, wherein the third resistor is connected to the output.

20. The voltage regulator circuit of claim 17, wherein the first resistor is connected to the ground.

* * * * *